US009999957B2

(12) United States Patent
Choi et al.

(10) Patent No.: US 9,999,957 B2
(45) Date of Patent: Jun. 19, 2018

(54) POLISHING HEAD AND POLISHING CARRIER APPARATUS HAVING THE SAME

(71) Applicant: SAMSUNG ELECTRONICS CO., LTD., Suwon-si, Gyeonggi-do (KR)

(72) Inventors: Yun-Seok Choi, Hwaseong-si (KR); Chang-Gil Ryu, Yongin-si (KR); Geun-Young Song, Suwon-si (KR); Ki-Yeon Chu, Hwaseong-si (KR); Jin-Suk Hong, Hwaseong-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 197 days.

(21) Appl. No.: 15/001,410

(22) Filed: Jan. 20, 2016

(65) Prior Publication Data

US 2016/0236318 A1 Aug. 18, 2016

(30) Foreign Application Priority Data

Feb. 16, 2015 (KR) ..... 10-2015-0023076

(51) Int. Cl.

| | |
|---|---|
| ***B24B 37/32*** | (2012.01) |
| ***B24B 55/02*** | (2006.01) |
| ***B24B 37/30*** | (2012.01) |

(52) U.S. Cl.

CPC ..... *B24B 37/32* (2013.01); *B24B 37/30* (2013.01); *B24B 55/02* (2013.01)

(58) Field of Classification Search

CPC ..... B24B 37/30; B24B 37/32; B24B 55/02

See application file for complete search history.

(56) References Cited

U.S. PATENT DOCUMENTS

| | | | | |
|---|---|---|---|---|
| 6,150,271 | A | 11/2000 | Easter et al. | |
| 6,419,567 | B1 * | 7/2002 | Glashauser | B24B 37/32 451/259 |
| 6,686,284 | B2 * | 2/2004 | Chung | B24B 37/32 156/345.27 |
| 6,749,484 | B2 | 6/2004 | Yang et al. | |
| 7,169,014 | B2 | 1/2007 | Taylor et al. | |
| 7,214,123 | B2 | 5/2007 | Han | |
| 8,469,776 | B2 * | 6/2013 | Zuniga | B24B 37/30 428/119 |

FOREIGN PATENT DOCUMENTS

| | | | |
|---|---|---|---|
| JP | 2005-169568 | A | 6/2005 |
| KR | 10-2005-0002307 | A | 1/2005 |
| KR | 10-2006-0133639 | A | 12/2006 |
| KR | 10-0721756 | B1 | 5/2007 |
| KR | 10-2009-0106886 | A | 10/2009 |

* cited by examiner

*Primary Examiner* — Timothy V Eley
(74) *Attorney, Agent, or Firm* — Lee & Morse P.C.

(57) ABSTRACT

A polishing head includes a substrate carrier to suck and to pressurize a substrate, and a retainer ring secured under the substrate carrier, the retainer ring surrounding a circumference of the substrate and including a cooling channel therethrough to circulate a coolant fluid.

17 Claims, 7 Drawing Sheets

POLISHING HEAD AND POLISHING CARRIER APPARATUS HAVING THE SAME

CROSS-REFERENCE TO RELATED APPLICATION

Korean Patent Application No. 10-2015-0023076, filed on Feb. 16, 2015, in the Korean Intellectual Property Office, and entitled: "Polishing Head and Polishing Carrier Apparatus Having the Same," is incorporated by reference herein in its entirety.

BACKGROUND

1. Field

Example embodiments relate to a polishing head and a polishing carrier apparatus having the same. More particularly, example embodiments relate to a polishing head for pressing and moving a wafer against a polishing pad and a polishing carrier apparatus having the same.

2. Description of the Related Art

A chemical mechanical polishing (CMP) process is a semiconductor manufacturing process that uses a chemical solution including slurry and a polishing pad in a manner such that a chemical reaction is induced on a wafer and a mechanical force is transmitted to the wafer so as to planarize a surface of the wafer. A CMP apparatus may include a platen, a polishing pad, and a polishing head.

SUMMARY

According to example embodiments, a polishing head including a substrate carrier to suck and to pressurize a substrate, and a retainer ring secured under the substrate carrier, the retainer ring surrounding a circumference of the substrate and including a cooling channel therethrough to circulate a coolant fluid.

In example embodiments, the cooling channel may be in fluid communication with a fluid connection passage extending through the substrate carrier.

In example embodiments, the polishing head may further include a coolant fluid tube which is connected to the fluid connection passage, and the coolant fluid may be supplied to or collected from the cooling channel through the coolant fluid tube.

In example embodiments, the retainer ring may further include an input/output pathway which extends inwardly from an upper surface of the retainer ring to be connected to the cooling channel.

In example embodiments, the cooling channel may include a first cooling channel recess extending inwardly from an upper surface of the retainer ring and a second cooling channel recess extending inwardly from the upper surface of the retainer ring and connected to the first cooling channel recess.

In example embodiments, the first cooling channel recess may have a first width and the second cooling channel recess may have a second width smaller than the first width.

In example embodiments, the substrate carrier may include a housing detachably fixed to a drive shaft, a base assembly installed beneath the housing and vertically movable with respect to the housing, and a flexible membrane clamped to a lower portion of the base assembly to form at least one a pressurizing chamber and contacting a backside of the substrate.

In example embodiments, a coolant fluid pathway may be formed through the housing to be connected to a coolant fluid passage of the drive shaft and a fluid connection passage may be formed through the base assembly to be connected to the cooling channel. The polishing head may further include a coolant fluid tube which connects the coolant fluid pathway and the fluid connection passage.

In example embodiments, the flexible membrane may include a disk-shaped main portion having a first surface contacting the backside of the substrate and a second surface opposite to the first surface, and at least one extending portion protruding from the second surface of the main portion to form the pressurizing chamber.

In example embodiments, the retainer ring may include at least one groove provided in a lower surface of the retainer ring and extending from an inner surface to an outer surface of the retainer ring.

According to example embodiments, a retainer ring includes an annular body having an upper surface fixed to a lower surface of a substrate carrier and a lower surface contacting and pressing a polishing pad, and a cooling channel extending through the body and circulating a coolant fluid therethrough.

In example embodiments, the retainer ring may further include an input/output pathway which extends inwardly from the upper surface of the body to be connected to the cooling channel.

In example embodiments, the cooling channel may include a first cooling channel recess extending inwardly from the upper surface of the body and a second cooling channel recess extending inwardly from the upper surface of the body and connected to the first cooling channel recess.

In example embodiments, the first cooling channel recess may have a first width and the second cooling channel recess may have a second width smaller than the first width.

In example embodiments, the retainer ring may further include a sealing recess formed in the upper surface of the body and configured to provide a fluid-tight seal for the cooling channel.

According to example embodiments, a polishing carrier apparatus includes a rotary union including a drive shaft and a seal housing supporting the drive shaft to be rotatable on its own axis and flowing a coolant fluid into a coolant fluid passage formed through the drive shaft in a sealed-up state, a polishing head including a substrate carrier fixed to the drive shaft to rotate therewith and configured to suck and pressurize a substrate and a retainer ring secured under the substrate carrier, surrounding a circumference of the substrate and including a cooling channel formed therein to circulate a coolant fluid therethrough, and a coolant fluid supply unit connected to the rotary union and supplying and collecting the coolant fluid to and from the coolant fluid passage of the drive shaft In example embodiments, a gas passage may be formed through the drive shaft of the rotary union and a gas may be supplied to the substrate carrier through the gas passage. The polishing carrier apparatus may further include a gas supply unit connected to the rotary union and supplying the gas to the gas passage of the drive shaft.

In example embodiments, the polishing carrier apparatus may further include a drive shaft driving unit for rotating the drive shaft.

In example embodiments, the substrate carrier may include a housing detachably fixed to the drive shaft, a base assembly installed beneath the housing and vertically movable with respect to the housing, and a flexible membrane clamped to a lower portion of the base assembly to form at least one a pressurizing chamber and contacting a backside of the substrate.

In example embodiments, a coolant fluid pathway may be formed through the housing to be connected to the coolant fluid passage of the drive shaft and a fluid connection passage may be formed through the base assembly to be connected to the cooling channel. The polishing carrier apparatus may further include a coolant fluid tube which connects the coolant fluid pathway and the fluid connection passage.

According to example embodiments, a polishing head includes a substrate carrier to suck and to pressurize a substrate, and a retainer ring connected to a bottom of the substrate carrier and surrounding a circumference of the substrate, the retainer ring including a cooling channel therethrough that is in fluid communication with a coolant fluid supply unit external to the polishing head.

In example embodiments, the cooling channel may extend through an entire perimeter of the retainer ring.

In example embodiments, the retainer ring may include a vertical bore extending from the cooling channel toward the substrate carrier to be in fluid communication with the coolant fluid supply unit, a width of the cooling channel being larger than a width of the vertical bore.

In example embodiments, the retainer ring may further include input and output passageways in fluid communication with the cooling channel and the coolant fluid supply unit.

In example embodiments, the retainer ring may have inner and outer lateral surfaces, a difference between diameters of the inner and outer lateral surfaces defining a width of the retainer ring, and a width of the cooling channel being larger than half the width of the retainer ring.

BRIEF DESCRIPTION OF THE DRAWINGS

Features will become apparent to those of ordinary skill in the art by describing in detail exemplary embodiments with reference to the attached drawings, in which.

DETAILED DESCRIPTION

Figure 1:
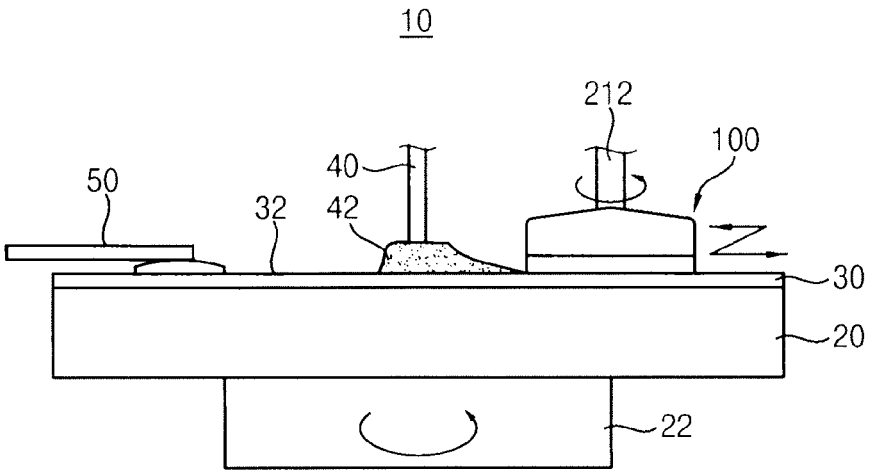
FIG. 1 illustrates a cross-sectional view of a chemical mechanical polishing apparatus in accordance with example embodiments.

Various example embodiments will be described more fully hereinafter with reference to the accompanying drawings, in which example embodiments are shown. Example embodiments may, however, be embodied in many different forms and should not be construed as limited to those set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, example embodiments will be explained in detail with reference to the accompanying drawings.

Figure 2:
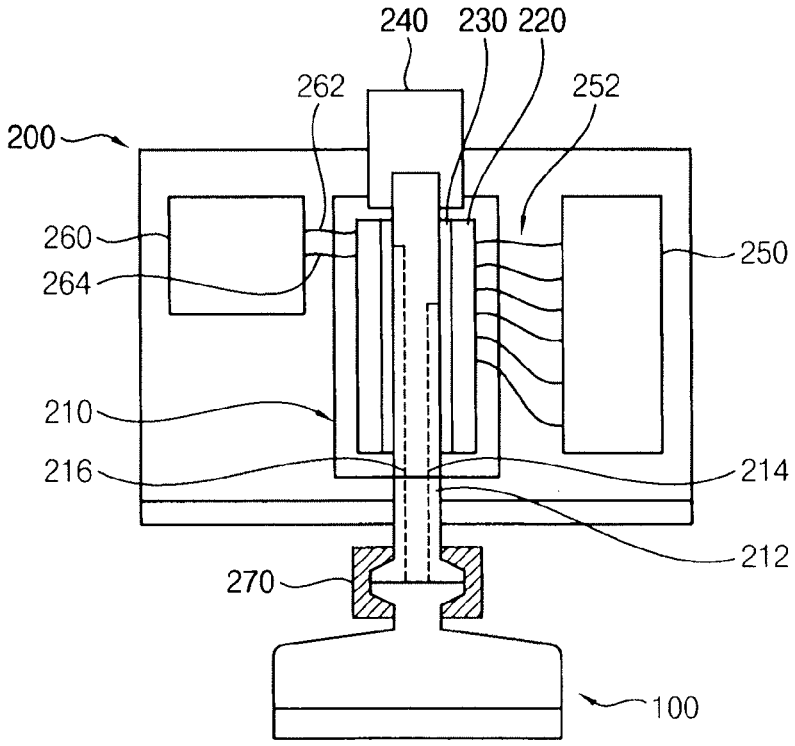
FIG. 2 illustrates a cross-sectional view of a polishing carrier apparatus in FIG. 1.

FIG. 1 is a cross-sectional view illustrating a chemical mechanical polishing apparatus in accordance with example embodiments. FIG. 2 is a cross-sectional view illustrating a polishing carrier apparatus in FIG. 1.

Referring to FIGS. 1 and 2, a chemical mechanical polishing (CMP) apparatus 10 may include a platen 20, a polishing pad 30, a polishing carrier apparatus 200 having a polishing head 100, a slurry dispenser 40, and a pad conditioner 50.

The platen 20 may rotate the polishing pad 30 at a desired speed in order to polish a substrate, e.g., a wafer. The polishing pad 30 may be positioned on the platen 20. The platen 20 may have a disc shape. A platen driving unit 22 may include a platen driving motor which is connected to the platen 20 through a platen rotation shaft. The platen 20 may be rotated by the platen rotation shaft.

The polishing pad 30 may include abrasive particles formed thereon to polish the substrate. The polishing pad 30 may include an elastomeric material having a rough surface, e.g., polyurethane. The polishing pad 30 may be rotated by the platen 20.

The slurry dispenser 40 may dispense a slurry solution 42 onto the polishing pad 30. The slurry solution 42 may be used to perform a chemical mechanical polishing process. The slurry solution 42 may be used to chemically planarize the wafer. Abrasive particles contained in the slurry solution 42 may polish the substrate as the polishing pad 30 is rotated. The abrasive particles may be formed of fine grains to reduce scratches on the surface of the substrate.

The polishing head 100 may hold the substrate and press its surface to be polished against the polishing pad 30. The polishing head 100 may be connected to and combined with a drive shaft 212 of the polishing carrier apparatus 200 to move on the polishing pad 30 while rotating.

The pad conditioner 50 may be provided to reduce the abrasion of the polishing pad 30. After a period of use, protuberances on the polishing pad 30 may be worn by friction between the polishing pad 30 and the substrate. The pad conditioner 50 may regenerate the rough surface of the polishing pad 30 to maintain acceptable and consistent removal rates. Accordingly, the polishing pad 30 may be used for an extended time without being replaced.

The polishing carrier apparatus 200 may be adapted to pressurize the substrate with the polishing head 100 above the platen 20, and to revolve the polishing head 100 on a central axis of the platen 20 and to rotate the polishing head 100 on a central axis of the polishing head 100. The polishing carrier apparatus 200 will be described in detail with reference to FIG. 2.

As illustrated in FIG. 2, the polishing carrier apparatus 200 may include the polishing head 100, a rotary union 210, a gas supply unit 250, and a coolant fluid supply unit 260.

The rotary union 210 may include the drive shaft 212, in which a plurality of gas passages 214 and a plurality of coolant fluid passages 216 are formed, and a seal housing 220 surrounding the drive shaft 212. The drive shaft 212 extends through and is supported by the seal housing 220, and is rotatable on its own axis within the seal housing 220. Fluid flows through the gas passages 214 and the coolant fluid passages 216 of the drive shaft 212 in a sealed-up state. The seal housing 220 may include through-holes formed therein which are connected to the gas passages 214 and the coolant fluid passages 216 respectively.

The drive shaft 212 may be connected to a driving motor of a drive shaft driving unit 240 to rotate on its own axis. For example, a driven gear may be installed in an upper portion of the drive shaft 212, and the driving motor may rotate a driving gear, which is engaged with the driven gear in the drive shaft 212, to rotate the drive shaft 212.

A stack sealing part 230 may be interposed between the drive shaft 212 and the seal housing 220. The stack sealing part 230 may prevent a leakage of fluid from the drive shaft 212 rotating at a given speed. The stack sealing part 230 may include a rotary ring serving as a metal portion which rotates together with the drive shaft 212, and a fixation ring configured such that the seal housing 220 closely adheres to the rotary ring and thus performs a sliding movement. A plurality of the rotary rings and a plurality of the fixation rings may be stacked alternately on each other to form the stack sealing part. Accordingly, the stack sealing part 230 may connect the gas passages 214 and the coolant fluid passages 216 of the drive shaft 212 to the through-holes of the seal housing 220 in a sealed-up state, respectively, when the drive shaft 212 rotates within the seal housing 220.

The rotary union 210 may be connected to the gas supply unit 250 through gas tubes 252. The gas tubes 252 may be connected to the through-holes of the seal housing 220 such that gas is supplied from the gas supply unit 250 through the gas tubes 252 to the gas passages 214 of the drive shaft 212. Accordingly, as described below, the gas supply unit 250 may supply gas into the polishing head 100 through the gas passages 214 of the drive shaft 212 in order to provide suction and pressurization of an object to be polished.

The rotary union 210 may be connected to the coolant fluid supply unit 260 through coolant fluid tubes 262 and 264. The coolant fluid tubes 262 and 264 may be connected to the through-holes of the seal housing 220 such that a coolant fluid is supplied from the coolant fluid supply unit 260 through the coolant fluid tubes 262 and 264 to the coolant fluid passages 216 of the drive shaft 212. Accordingly, as will be described below, the coolant fluid supply unit 260 may circulate a coolant fluid to a cooling channel 132, 162*a*, 162*b* of a retainer ring 130 of the polishing head 100 (see FIG. 8, FIG. 11 and FIG. 12) through the coolant fluid passages 216. For example, the coolant fluid supply unit 260 may supply a coolant fluid to the rotary union 210 through a first coolant fluid tube 262 and collect the coolant fluid from the rotary union 210 through a second coolant fluid tube 264.

The polishing head 100 may be combined with the drive shaft 212 to rotate together with the drive shaft 212. The polishing head 100 may be fixed to a flange of the drive shaft 212 by a clamp 270. Hereinafter, the polishing head will be explained in detail.

Figure 3:
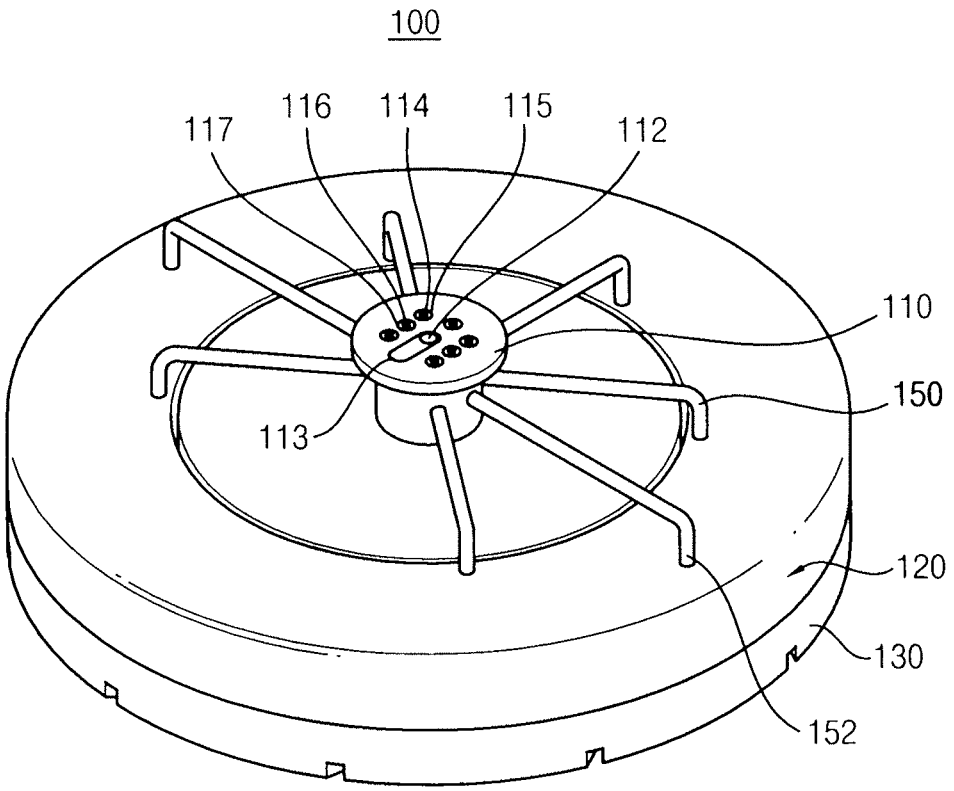
FIG. 3 illustrates a perspective view of a polishing head in accordance with example embodiments.
Figure 4:
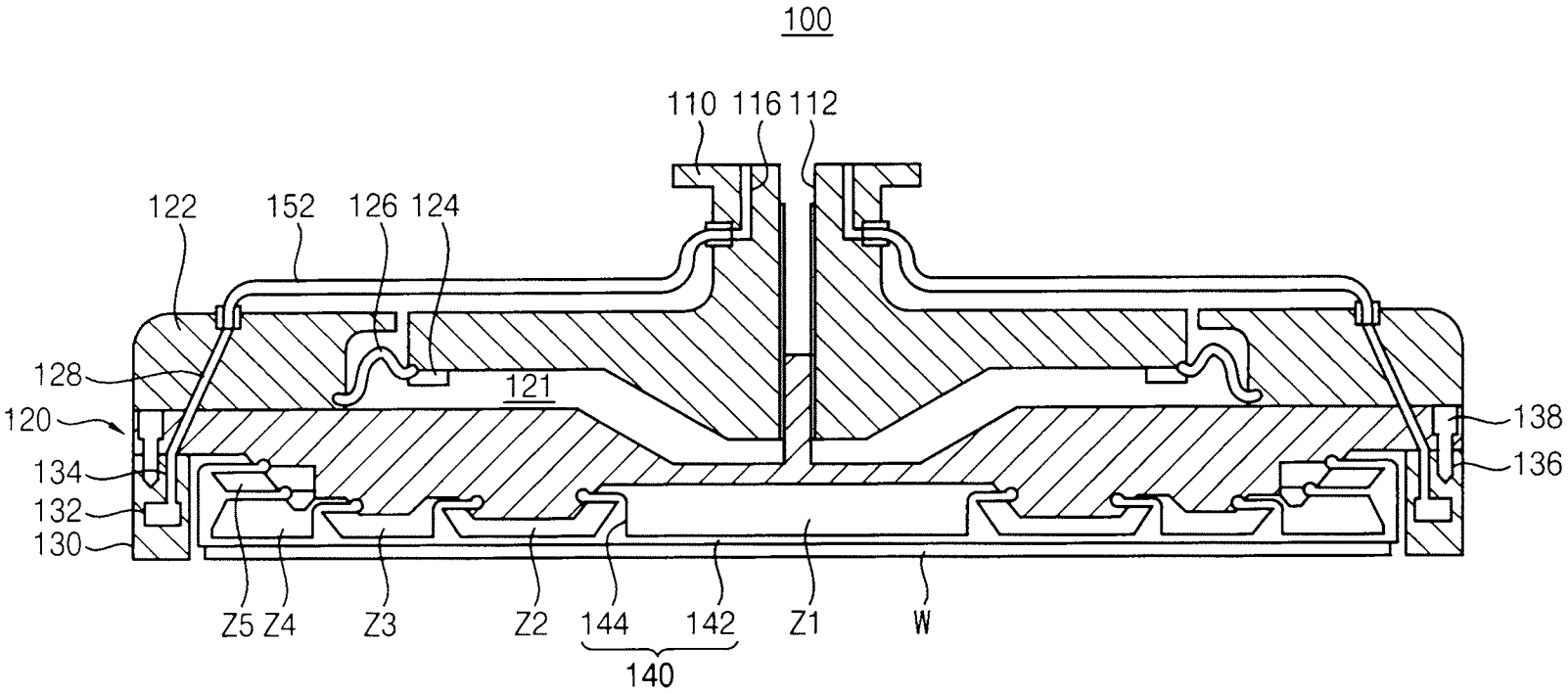
FIG. 4 illustrates a cross-sectional view of the polishing head in FIG. 3.
Figure 5:
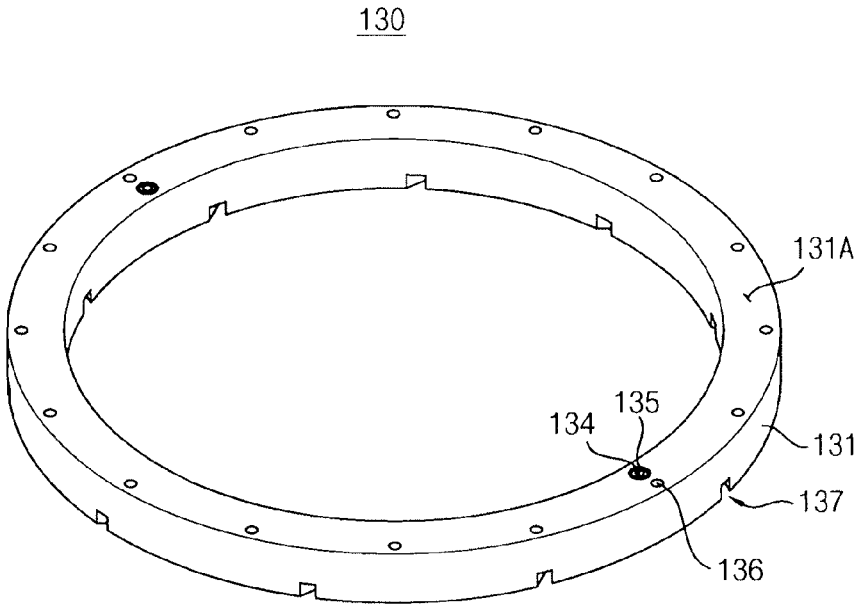
FIG. 5 illustrates a perspective view of a retainer ring of the polishing head in FIG. 3.
Figure 6:
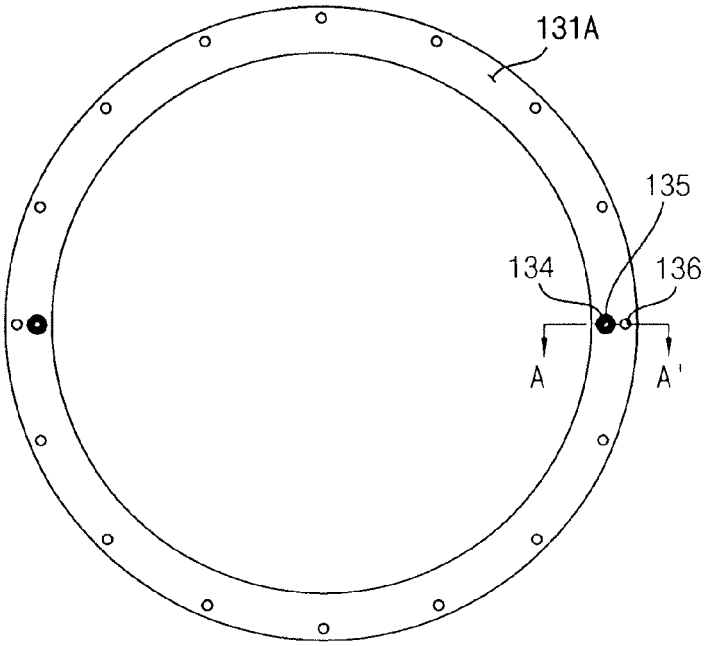
FIG. 6 illustrates a plan view of the retainer ring in FIG. 5.
Figure 7:
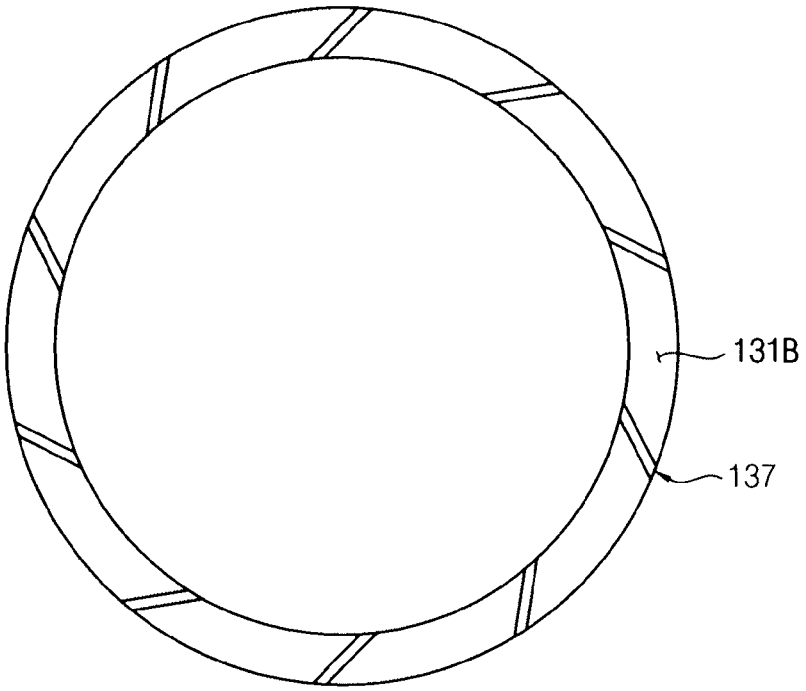
FIG. 7 illustrates a bottom view of the retainer ring in FIG. 5.
Figure 8:
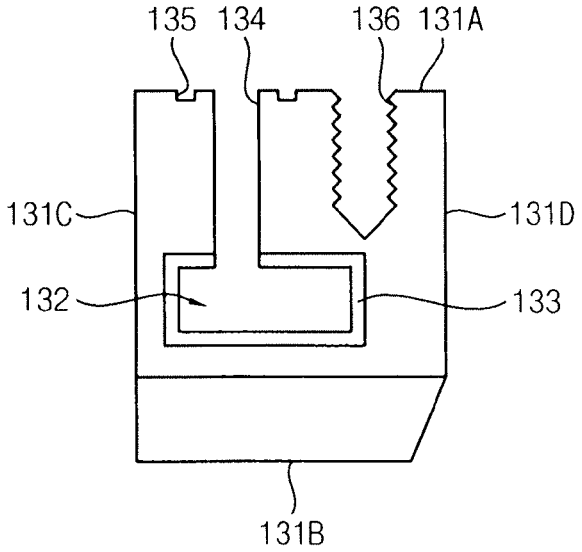
FIG. 8 illustrates a cross-sectional view taken along the line A-A' in FIG. 6.

FIG. 3 is a perspective view illustrating the polishing head 100. FIG. 4 is a cross-sectional view illustrating the polishing 100. FIG. 5 is a perspective view illustrating a retainer ring of the polishing head 100. FIG. 6 is a plan view illustrating the retainer ring 100. FIG. 7 is a bottom view illustrating the retainer ring in FIG. 5. FIG. 8 is a cross-sectional view taken along line A-A' in FIG. 6.

Referring to FIGS. 2 to 8, the polishing head 100 may include a substrate carrier fixed to a drive shaft 212 to rotate together with the drive shaft 212 and to suck and pressurize a substrate, e.g., a wafer, as an object to be polished. The polishing head 100 may further include the retainer ring 130 secured under the substrate carrier. The retainer ring 130 may surround a circumference of the substrate, e.g., the retainer ring 130 may completely surround a wafer W. The retainer ring 130 includes a cooling channel 132 formed therein to circulate a coolant fluid, e.g., around the wafer W (FIG. 4).

In detail, referring to FIGS. 3-4, the substrate carrier may include a housing 110 detachably fixed to the drive shaft 212, a base assembly 120 installed beneath the housing 110 and vertically movable with respect to the housing 110, and a flexible membrane 140 clamped to a lower portion of the base assembly 120 to form at least one pressurizing chamber, e.g., a plurality of pressurizing chambers Z1, Z2, Z3, Z4, Z5. The flexible membrane 140 may contact a backside of the substrate.

For example, the housing 110 may have a circular shape. The housing 110 may be connected to the drive shaft 212 to rotate therewith during polishing. An upper portion of the housing 110 may be fixed to the flange of the drive shaft 212 by the clamp 270. A vertical bore 112 may be formed through the housing 110, and a plurality of gas pathways 114 and coolant fluid pathways 116 may be formed to extend, e.g., vertically, through the housing 110. A plurality of O-rings, e.g., O-rings 113, 115, and 117, may be disposed between an upper surface of the housing 110 and a lower surface of the drive shaft 212 to form fluid-tight seals between the plurality of gas and coolant fluid pathways 114 and 116, and corresponding gas and coolant fluid passages 214 and 216 passages.

Accordingly, the vertical bore 112 and the gas pathways 114 for pneumatic control of the polishing head 100 may be connected to the gas passages 214 formed in the drive shaft 212, respectively. The coolant fluid pathways 116 for cooling control of the polishing head 100 may be connected to the coolant fluid passages 216 formed in the drive shaft 212, respectively.

The base assembly 120 may be vertically movable under the housing 110. A level maintenance rod of the base assembly 120 may slide vertically within the vertical bore 120 to provide a vertical motion of the base assembly 120. As illustrated in FIG. 4, an outer clamp ring 122 may be disposed on a generally rigid annular body of the base assembly 120, an inner clamp ring 124 may be disposed at the outer edge of the housing 110 beneath the housing 110, and a rolling diaphragm 126 may be clamped to the housing 110 by the outer clamp ring 122 and the inner claim ring 124. A loading chamber 121 may be located between the housing 110 and the base assembly 120 to apply a load, i.e., a downward pressure or weight, to the base assembly 120. The vertical position of the base assembly 120 relative to the polishing pad 30 is also controlled by the loading chamber 121.

The retainer ring 130 may be fixed to a lower portion of the substrate carrier, e.g., the base assembly 120 may be between the retainer ring 130 and the housing 110. As described below, the retaining ring 130 may be a generally annular ring secured at the outer edge of the base assembly 120, i.e., secured to a surface of the base assembly 120 facing away from the housing 110. When a working fluid is pumped into the loading chamber 121, the base assembly 120 moves downwardly toward the retaining ring 130, which in turn, causes the retaining ring 130 to also move downwardly to apply a load to the polishing pad 30.

The flexible membrane 140 may be clamped to the lower portion of the base assembly 120 within the retainer ring 130. The flexible membrane 140 may include a disk-shaped main portion 142 having a first surface contacting the backside of the substrate, e.g., a wafer W, and a second surface opposite to the first surface, and a plurality of extending portions 144 protruding from the second surface of the main portion 142 to form a plurality of pressurizing chambers, e.g., first to fifth pressurizing chambers Z1, Z2, Z3, Z4, Z5.

The first surface of the main portion 142 may provide a suction surface for the wafer W, and may contact the backside of the wafer W. End portions of the extending portions 144 may be clamped to the base assembly 120 by clamp rings respectively, such that a plurality of pressurizing chambers having an annular or circular shape may be formed among the extending portions 144, respectively. The number of the pressurizing chambers may be determined according to the number of the extending portions 144. For example, the pressurizing chamber may be defined between two adjacent extending portions 144, so a central pressurizing chamber may have a circular shape, and each additional pressurizing chamber may be a concentric ring-shaped chamber defined between two adjacent extending portions 144 and surrounding the central pressurizing chamber. For example, the flexible membrane 140 may be a five-zone type membrane for forming five pressurizing chambers, e.g., four ring-shaped concentric pressurizing chambers surrounding a circular pressurizing chamber. However, embodiments are not limited thereto, e.g., the flexible membrane may be a seven-zone type membrane for forming seven pressurizing chambers.

Each pressurizing chamber may be in fluid communication with the gas passage 214 of the drive shaft 212 through the gas pathway 114 of the housing 110 and a passage penetrating the base assembly 120. The passage in the base assembly 120 may be in fluid communication with the gas pathway 114 of the housing 101 through a flexible gas tube 150 (FIG. 3) which extends inside the loading chamber 121 or outside the substrate carrier. For example, each flexible gas tube 150 may have a structure similar to that of a coolant fluid tube 152 described below, e.g., a length of the flexible gas tube 150 may be shorter than a length of the coolant fluid tube 152 (FIG. 3), and may be connected to a respective pressurizing chamber through the passage, e.g., having a structure similar to that of a passage 128 of the base assembly 120 to be described below.

Accordingly, the pressurizing chambers may be in fluid communication with the gas tubes 252 of the gas supply unit 250, respectively, such that the pressure of each pressurizing chamber may be independently controlled, e.g., through respective independent gas tubes 150. For example, at least one of the pressurizing chambers may be empties to provide a vacuum atmosphere to vacuum chuck the wafer (W). In another example, at least one of the pressurizing chambers may be filled with a predetermined amount of gas to provide pressure to force, e.g., push, the flexible membrane 140 against the wafer (W).

The configurations of the various elements in the carrier head, e.g., the housing 110, the base assembly 120, or the extending portions 144 of the flexible membrane 140 are illustrative and not limiting. For example, the carrier head could be constructed without the loading chamber 121, so the base assembly 120 and the housing 110 may be a single structure or assembly.

As illustrated in FIGS. 5 to 8, in example embodiments, the retainer ring 130 may include an annular body 131 and the cooling channel 132 extending through the body 131 and circulating a coolant fluid.

An upper surface 131A of the body 131 may be fixed to the lower surface of the base assembly 120. For example, as illustrated in FIGS. 5-6, a plurality of thread grooves 136 may be formed in the upper surface 131A of the body 131 to be spaced apart from each other along an extending direction of the body 131. Fastening bolts 138 (FIG. 4) may penetrate the base assembly 120 to be engaged with the thread grooves 136 of the retainer ring 130, respectively, so that the retainer ring 130 may be fixed to the lower surface of the substrate carrier.

As illustrated in FIGS. 6 and 8, the cooling channel 132 may extend inside the body 131 in the circumferential direction of the body 131, e.g., the cooling channel 132 may extend within the body 131 along the entire circumference of the body 131. An input/output pathway 134 may extend inwardly from the upper surface 131A of the body 131 toward a bottom of the body 131 to be connected to the cooling channel 132. At least two, e.g., independent, input/output pathways 134 may be formed in the body 131, and one of two input/output pathway 134 may be used as an input port for supplying a coolant fluid to the cooling channel 132 and another of two input/output pathway 134 may be used as an output port for collecting the coolant fluid from the cooling channel 132.

The body 131 may include a plastic material, e.g., PEEK (polyetheretherketone), PPS (polyphenylene sulfide), PET (polyethylene terephthalate), PI (polyimide). etc. The body 131 may be formed by stacking a plurality of processed rings. Additionally, a channel recess for the cooling channel 132 may be formed in at least one of the stacked processed rings forming the body 131, and a metal layer 133, e.g., stainless steel, may be formed on the channel recess, e.g., the metal layer 133 may be formed conformally on an interior surface of the channel recess. The metal layer 133 in at least one processed ring with the channel recess may define, e.g., surround, the cooling channel 132 (FIG. 8), and the input/output pathways 134 may penetrate the metal layer 133 to be in fluid communication with the cooling channel 132.

A sealing recess 135 may be formed in the upper surface 131A of the body 131 to surround the input/output pathway 134. An O-ring may be disposed in the sealing recess 135 between the upper surface 131A of the retainer ring 130 and the lower surface of the base assembly 120 to form a fluid-tight seal for the cooling channel 132.

The polishing head 100 may further include a flexible coolant fluid tube 152 for circulating the coolant fluid. In particular, as illustrated in FIG. 4, the cooling channel 132 may be in fluid communication with a passage 128 penetrating the base assembly 120, and the passage 128 of the base assembly 120 may be in fluid communication with the coolant fluid tube 152 which extends inside the loading chamber 121 or outside the substrate carrier. The flexible coolant fluid tube 152 may be connected to the coolant fluid pathway 116 of the housing 110. The coolant fluid pathway 116 of the housing 110 may be connected to the coolant fluid passage 216 of the drive shaft 212.

Accordingly, the cooling channel 132 may be in fluid communication with the coolant fluid tubes 262 and 264 of the coolant fluid supply unit 260, such that the coolant fluid may circulate through the cooling channel 132 of the retainer ring 130. The circulation of the coolant fluid through the cooling channel 132 may be controlled by the coolant fluid supply unit 260. As the coolant fluid circulates through the coolant channel 132 in the retainer ring 130, the heat in the polishing pad 30 generated due to friction between the polishing head 100 and the polishing pad 30 may be removed, e.g., heat generated between the retainer ring 130 and the polishing pad 30 during contact therebetween may be removed via the coolant fluid in the coolant channel 132 of the retainer ring 130. Accordingly, the temperature of the polishing pad 30 may be controlled, and an edge profile of the wafer W during a CMP process may be improved.

As illustrated in FIGS. 5 and 7, a plurality of grooves 137 may be provided in a lower surface 131B of the body 131. Each groove 137 may extend from an inner surface 131C to an outer surface 131D of the body 131 (FIGS. 7-8). Polish scraps generated during the CMP process may be discharged through the plurality of grooves 137 to the outside of the polishing head 100.

As described previously above, the retainer ring 130 of the polishing head 100 may include the cooling channel 132 formed therein to circulate a coolant fluid therethrough, and the circulation of the coolant fluid through the cooling channel 132 may be controlled by the external coolant fluid supply unit 260. Accordingly, when the polishing head 100 is rotated on the polishing pad 30, the retainer ring 130 contacting the polishing pad 30 may be cooled. Therefore, an increase in temperature of the polishing pad 30 may be prevented or substantially minimized, thereby preventing and a property change of the polishing pad 30 and optimizing a polishing profile of an edge region of the wafer W to improve a uniform surface polishing rate.

Figure 9:
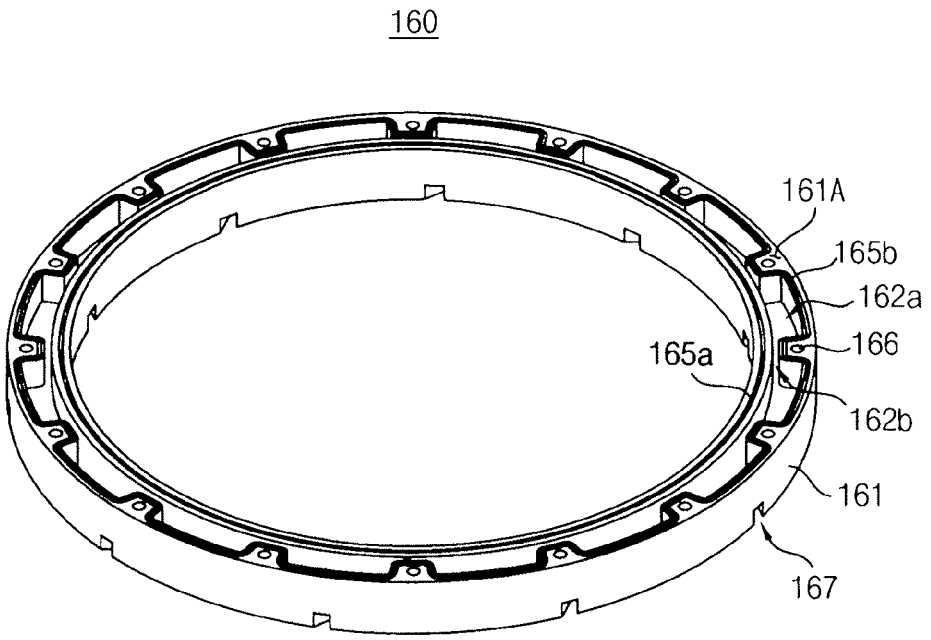
FIG. 9 illustrates a perspective view of a retainer ring of a polishing head in accordance with example embodiments.
Figure 10:
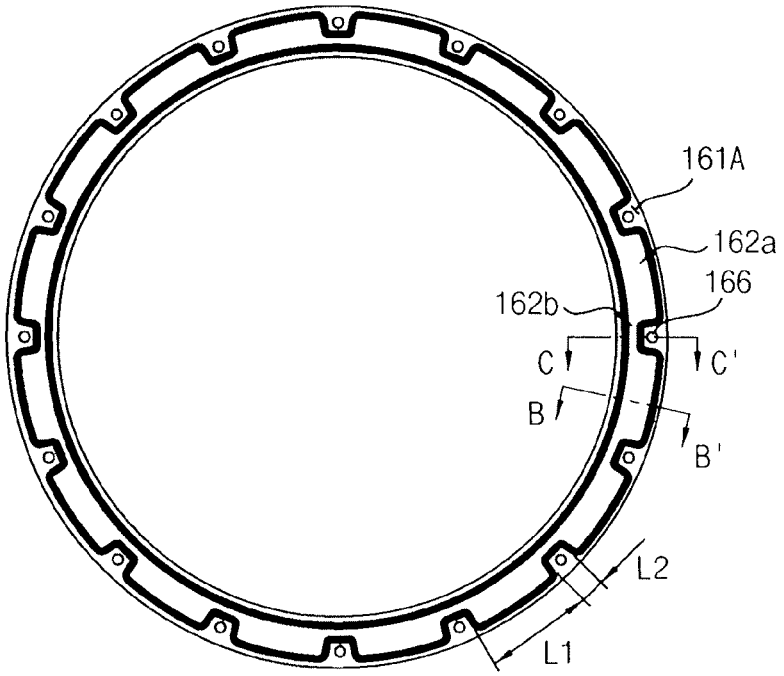
FIG. 10 illustrates a plan view of the retainer ring in FIG. 9.
Figure 11:
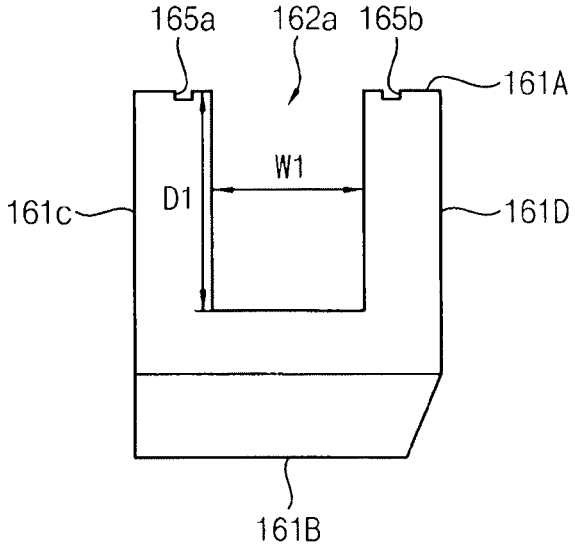
FIG. 11 illustrates a cross-sectional view taken along the line B-B' in FIG. 10.
Figure 12:
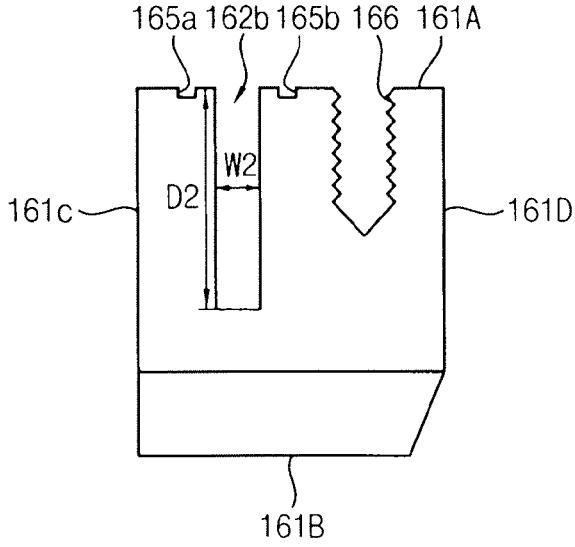
FIG. 12 illustrates a cross-sectional view taken along the line C-C' in FIG. 10.

FIG. 9 is a perspective view illustrating a retainer ring of a polishing head in accordance with example embodiments. FIG. 10 is a plan view illustrating the retainer ring in FIG. 9. FIG. 11 is a cross-sectional view taken along the line B-B' in FIG. 10. FIG. 12 is a cross-sectional view taken along the line C-C' in FIG. 10. The retainer ring in FIGS. 9-12 may be substantially the same as or similar to the retainer ring 130 described with reference to FIGS. 5 to 8, except for the cooling channel. Thus, same reference numerals will be used to refer to the same or like elements as those described with reference to FIGS. 5 to 8, and any further repetitive explanation concerning the above elements will be omitted.

Referring to FIGS. 9 to 12, a retainer ring 160 may include an annular body 161 and a cooling channel extending through the body 161 and circulating a coolant fluid. The cooling channel may include a first cooling channel recess 162*a* and a second cooling channel recess 162*b* connected to each other in an extending direction of the body 161.

A plurality of the first cooling channel recesses 162*a* may be formed in the body 161 to be spaced apart from each other along the extending direction of the body 161. A plurality of the second cooling channel recesses 162*b* may be formed in the body 161 to be spaced apart from each other along the extending direction of the body 161. The first cooling channel recess 162*a* may extend inwardly from an upper surface 161A of the body 161. The second cooling channel recess 162*b* may extend inwardly from the upper surface 161A of the body 161. The first cooling channel recess 162*a* and the second cooling channel recess 162*b* may be, e.g., arranged alternately and be, connected to each other to form the cooling channel.

The first cooling channel recess 162*a* may have a first width W1 and the second cooling channel recess 162*b* may have a second width W2 smaller than the first width W1. The first cooling channel recess 162*a* may have a first length L1 and the second cooling channel recess 162*b* may have a second length L2 smaller than the first length L2. A first depth D1 of the first cooling channel recess 162*a* may be the same as or different from a second depth D2 of the second cooling channel recess 162*b*.

A first sealing recess 165*a* and a second sealing recess 165*b* may be formed in the upper surface 161A of the body 161 to surround the cooling channel. O-rings may be disposed in the first and second sealing recesses 165*a* and 165*b* between the upper surface 161A of the retainer ring 160 and a lower surface of the base assembly 120 to form a fluid-tight seal for the cooling channel.

A plurality of thread grooves 166 may be formed in the upper surface 161A of the body 161 to be spaced apart from each other along the extending direction of the body 161. The thread groove 166 may be formed between adjacent first cooling channel recesses 162*a*.

Some of the first cooing channel recesses 162*a* may be in fluid communication with the passage 128 penetrating the base assembly 120, and the passage 128 of the base assembly 120 may be in fluid communication with the flexible coolant fluid tube 152 which extends inside the loading chamber 121 or outside the substrate carrier. The flexible coolant fluid tube 152 may be connected to the coolant fluid pathway 116 of the housing 110. The coolant fluid pathway 116 of the housing 110 may be connected to the coolant fluid passage 216 of the drive shaft 212.

Accordingly, the first and second cooling channel recesses 162*a* and 162*b* forming the cooling channel may be in fluid communication with the coolant fluid tubes 262 and 264 of the coolant fluid supply unit 260 such that the coolant fluid may circulate through the cooling channel of the retainer ring 160. The circulation of the coolant fluid through the cooling channel may be controlled by the coolant fluid supply unit 260.

As the coolant fluid circulates through the coolant channel in the retainer ring 160, the heat in the polishing pad 30 generated due to friction between the polishing head 100 and the polishing pad 30 may be removed. Therefore, the temperature of the polishing pad 30 may be controlled to prevent an edge rebounding phenomenon of the polishing pad around an edge portion of the wafer during a CMP process.

As described above, the cooling channel in the retainer ring according to example embodiments may be designed to have an optimized shape in consideration of the edge profile of the wafer, thereby providing excellent cooling efficiency. Additionally, the polishing head may be connected to a temperature control system. The temperature control system may monitor the temperature of the retainer ring or the temperature of the coolant fluid in real time to control an amount, temperature, etc. of a circulated coolant fluid.

Although it is not illustrated in the figures, the retainer ring may include an inner retainer ring and an outer retainer ring having an annular shape. The inner retainer ring may be disposed within the outer retainer ring. The inner retainer ring may contact the edge portion of the wafer. At least one of the inner retainer ring and the outer retainer ring may have the above-mentioned cooling channel.

The polishing head having the retainer ring may be applied to a CMP process. Semiconductor devices, e.g., a dynamic random access memory (DRAM), VNAND, etc., manufactured using the CMP process may be used for various systems, e.g., a computing system. The system may be applied to, e.g., a computer, a portable computer, a laptop computer, a personal data assistant (PDA), a tablet, a mobile phone, a digital music player, etc.

By way of summation and review, when the polishing head is rotated to polish a wafer surface, a temperature of the polishing pad may rise due to friction between the polishing pad and the polishing head, and due to friction between the wafer and the polishing pad. The increase in temperature may deteriorate a polishing uniformity. Especially, heat generated by friction between the retaining ring of the polishing head and the polishing pad may change properties of the polishing pad. Thus, an edge rebounding phenomenon of the polishing pad around an edge portion of the wafer, in which a surface portion of the polishing pad protrudes convexly by a pressure of the retainer ring, may occur, thereby deteriorating the polishing uniformity.

In contrast, example embodiments provide a polishing head capable of preventing a temperature increase, thereby improving a polishing uniformity, and a polishing carrier apparatus having the polishing head. That is, according to example embodiments, a retainer ring of a polishing head may include a cooling channel formed therein to circulate a coolant fluid therethrough, and the circulation of the coolant fluid through the cooling channel may be controlled by an external coolant fluid supply unit. Thus, when the polishing head is rotated on the polishing pad, the retainer ring contacting the polishing pad may be cooled. Therefore, an increase in temperature of the polishing pad and a property change of the polishing pad may be prevented or substantially minimized, and a polishing profile of an edge region of the wafer may be optimized.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A polishing head, comprising:

a substrate carrier to suck and to pressurize a substrate; and a retainer ring secured under the substrate carrier to surround a circumference of the substrate, the retainer ring including a cooling channel therethrough to circulate a coolant fluid, wherein the cooling channel includes a first cooling channel recess extending inwardly from an upper surface of the retainer ring and a second cooling channel recess extending inwardly from the upper surface of the retainer ring and connected to the first cooling channel recess.

2. The polishing head as claimed in claim 1, wherein the cooling channel is in fluid communication with a fluid connection passage extending through the substrate carrier.

3. The polishing head as claimed in claim 2, further comprising a coolant fluid tube connected to the fluid connection passage, the coolant fluid being supplied to or collected from the cooling channel through the coolant fluid tube.

4. The polishing head as claimed in claim 1, wherein the retainer ring further comprises an input/output pathway extending inwardly from an upper surface of the retainer ring to be connected to the cooling channel.

5. The polishing head as claimed in claim 1, wherein the first cooling channel recess has a first width and the second cooling channel recess has a second width smaller than the first width.

6. The polishing head as claimed in claim 1, wherein the substrate carrier includes:

a housing detachably fixed to a drive shaft;

a base assembly installed under the housing, the base assembly being vertically movable with respect to the housing; and a flexible membrane clamped to a lower portion of the base assembly, the flexible membrane defining at least one pressurizing chamber to contact a backside of the substrate.

7. The polishing head as claimed in claim 6, further comprising:

a coolant fluid pathway through the housing, the coolant fluid pathway being connected to a coolant fluid passage of the drive shaft;

a fluid connection passage through the base assembly, the fluid connection passage being connected to the cooling channel; and a coolant fluid tube connecting the coolant fluid pathway in the housing and the fluid connection passage in the base assembly.

8. The polishing head as claimed in claim 6, wherein the flexible membrane includes:

a disk-shaped main portion having a first surface to contact the backside of the substrate and a second surface opposite to the first surface; and at least one extending portion protruding from the second surface of the main portion to define the at least one pressurizing chamber.

9. The polishing head as claimed in claim 1, wherein the retainer ring includes at least one groove in a lower surface thereof, the at least one groove extending from an inner surface to an outer surface of the retainer ring.

10. A retainer ring, comprising:

an annular body having an upper surface fixed to a lower surface of a substrate carrier and a lower surface to contact and press a polishing pad;

a cooling channel extending through the body to circulate a coolant fluid therethrough; and a sealing recess in the upper surface of the body to seal the cooling channel.

11. The retainer ring as claimed in claim 10, further comprising an input/output pathway extending inwardly from the upper surface of the body to be connected to the cooling channel.

12. The retainer ring as claimed in claim 10, wherein the cooling channel includes a first cooling channel recess extending inwardly from the upper surface of the body and a second cooling channel recess extending inwardly from the upper surface of the body and connected to the first cooling channel recess.

13. The retainer ring as claimed in claim 12, wherein the first cooling channel recess has a first width and the second cooling channel recess has a second width smaller than the first width.

14. A polishing head, comprising:

a substrate carrier to suck and to pressurize a substrate; and a retainer ring to be connected to a bottom of the substrate carrier and to surround a circumference of the substrate, the retainer ring including a cooling channel therethrough that is in fluid communication with a coolant fluid supply unit external to the polishing head, the retainer ring includes a vertical bore extending from the cooling channel toward the substrate carrier to be in fluid communication with the coolant fluid supply unit, a width of the cooling channel being is larger than a width of the vertical bore.

15. The polishing head as claimed in claim 14, wherein the cooling channel extends through an entire perimeter of the retainer ring.

16. The polishing head as claimed in claim 14, wherein the retainer ring further comprises input and output passageways in fluid communication with the cooling channel and the coolant fluid supply unit.

17. The polishing head as claimed in claim 14, wherein the retainer ring has an annular shape defined by outer and inner surfaces, a distance between the outer and inner surfaces defining a width of the retainer ring, and a width of the cooling channel being larger than half the width of the retainer ring.

* * * * *